US005893004A

United States Patent [19]

Yamamura

[11] Patent Number: 5,893,004

[45] Date of Patent: Apr. 6, 1999

[54] DEVELOPING UNIT

[75] Inventor: Takenori Yamamura, Kumamoto, Japan

[73] Assignee: NEC Corporation, Tokyo, Japan

[21] Appl. No.: 25,147

[22] Filed: Feb. 18, 1998

[30] Foreign Application Priority Data

Feb. 19, 1997 [JP] Japan ..... 9-034874

[51] Int. Cl.[6] ..... G03D 5/00

[52] U.S. Cl. ..... 396/611; 118/52; 427/240

[58] Field of Search ..... 396/611, 626, 396/627; 118/52, 54, 320, 321, 500, 666, 667, 668, 712; 355/43, 53; 134/2, 3, 24, 26, 33, 198, 144, 157; 427/240, 273, 331, 335, 336, 337

[56] References Cited

U.S. PATENT DOCUMENTS 4,113,492 9/1978 Sato et al. ..... 427/240

FOREIGN PATENT DOCUMENTS 60-53307 11/1985 Japan .

3-34207 5/1991 Japan .

*Primary Examiner*—D. Rutledge

*Attorney, Agent, or Firm*—Young & Thompson

[57] ABSTRACT

There is provided a solution heap control panel for ladling out a surplus developing solution that has been heaped up on a wafer to have a developing solution layer of a desired thickness and for passing and flowing downwards the ladled-out developing solution while rotating the wafer, so that a developing solution layer of a constant thickness is formed on the wafer. The ladled-out developing solution is dropped into a cup outside the wafer. Therefore, it is always possible to make constant the thickness of the developing solution layer without a traveling of the developing solution to the rear surface of the wafer in a developing unit.

8 Claims, 4 Drawing Sheets

DEVELOPING UNIT

BACKGROUND OF THE INVENTION

1. Field of the Invention

The present invention relates to a developing unit for developing a latent image transferred onto a photo-resist film of a semiconductor substrate by an exposing unit.

2. Description of Related Art

FIG. 1A and FIG. 1B are a schematic cross sectional diagram and an operational line diagram respectively of a conventional developing unit for explaining a developing unit. The conventional developing unit of this type has a rotary chuck 7 for holding and rotating a wafer 13 which is a semiconductor substrate, a developing solution nozzle 5 for dripping a developing solution on the wafer 13, a rinse solution nozzle 6 for dripping a rinse solution for rinsing the front surface of the wafer 13, and a cup 8 for collecting and discharging the developing solution and the rinse solution that have been scattered around by the rotation of the wafer 13, as shown in FIG. 1A, for example. A photosensitive resin film 14 is formed on the wafer 13. A numeral 15 is a developing solution layer. At the bottom of the cup 8, a nozzle 10 for supplying a rinse solution on a back surface of the wafer 13 and a nozzle 11 for blowing an air to the back surface of the wafer 13 are provided. A pipe 12 for discharging the wasted liquid from the cup 8. Also, a projection 9 is formed on the bottom surface of the cup 8 around the chuck 7.

For developing a latent image of the photo-sensitive resin film 14 of the wafer 13 by this developing unit, the wafer 13 is fitted to the rotary chuck 7 at first, as shown in FIG. 1B, and then an operation called a pre-spin is carried out. This operation is as follows. The wafer 13 is rotated for about 2 seconds at a speed of about 100 rotations per every second, for example. Thereafter, an operation of dripping a developing solution, called a pre-wetting, is carried out. During this operation, the rotation number of the wafer 13 is lowered at stages and the dripped developing solution extends over the whole front surface of the wafer 13 to form a developing solution layer 15 on it.

Next, in order to secure a wetting of the developing solution on the photo-sensitive resin, the wafer 13 is rotated at a very slow speed so that the heaped-up developing solution layer 15 fits well with the photo-sensitive resin film 14 and air bubbles disappear at the same time. Then, the rotation is stopped and a developing operation is carried out by the developing solution. The developing operation is carried out in a state that the wafer 13 is stopped for about 75 seconds, for example. When the developing operation has been completed, the wafer 13 is rotated again and, at the same time, the rinse solution is ejected from both the rinse solution nozzle 6 and a nozzle 10 at the rear surface side of the wafer 13 so that the developing solution on the front surface of the wafer 13 is washed out and the developing solution traveled to the rear side of the wafer 13 is also washed out to the outside of the wafer 13. After carrying out the washing by this rinse solution, the wafer 13 is rotated at a high speed so that the water content adhered to the front surface of the wafer is dispersed to the outside by the centrifugal force and the front surface of the wafer 13 is dried.

At the same time as the drying of the front surface of the wafer 13, dry air is also blown to the rear surface of the wafer 13 through a gap between a projection section 9 and the wafer 13 from a nozzle 11 provided at the rear surface side, to thereby dry the rear surface of the wafer 13. The developing solution and the rinsing solution within the cup 8 are discharged to the outside of unit through a waste solution discharging pipe 12. As explained above, by providing the nozzle 10 for ejecting the rinsing solution and the nozzle for blowing dry air at the rear surface side of the wafer 13, the remaining developing solution traveled to the rear surface of the wafer 13 has been removed and pollution of the wafer 13 due to the remaining developing solution has been eliminated, to thereby stabilize the quality.

Further, a method for preventing a developing solution from traveling to the rear surface of the wafer without a provision of a cleaning mechanism at the rear surface side has also been disclosed in the Japanese Patent Application Laid-open Publication No. 63-6843 (the Japanese Patent Application Publication No. 3-34207). According to this method, an end section of a cylindrical body almost concentric with the center of the rotation of a substrate is opposed to a peripheral section of the rear surface of the substrate with a minute gap formed therebetween, and the developing solution traveling from the peripheral section of the substrate is held in the gap section by the capillary effect so that the developing solution is inhibited from further traveling inside to the rear surface of the substrate.

According to the above-described prior-art developing unit having the cleaning and drying means at the rear surface side of the substrate, it is difficult to keep always constant the thickness of the developing solution which is dripped and heaped up on the surface of the wafer. Therefore, the dimensions of a latent image pattern fluctuate to be either large or small each time when the image is developed. Sometimes, there may occur such a problem that since the thickness of the heaped-up developing solution is so small that the image is developed incompletely, a so-called dropped-out phenomenon. Further, when the developing solution is heaped up to a very large thickness due to an excessive dripping of the developing solution, the developing solution drops from the peripheral edge of the wafer by the oscillation of the wafer at the time of the rotation of the wafer and the dropped developing solution travels to the rear surface so that this can not be removed even by the cleaning means, which results in a serious defect in quality.

On the other hand, according to the above-described method for providing a cylindrical body having a gap between the rear surface of the substrate and the cylindrical body, since the developing solution having traveled to the rear surface of the substrate at an outer side of the cylindrical body is kept adhered to the rear surface, it is difficult to completely remove this remaining developing solution by simply ejecting a washing solution afterwards. Further, it is impossible to remove the developing solution which entered into the gap between the substrate and the cylinder. Furthermore, since the cited reference does not have means for making constant the heaped-up thickness of the developing solution, there is a risk of an occurrence of the above-described problems.

Further, a developing method which eliminates the variation in the heaped-up thickness of the developing solution has been disclosed in the Japanese Patent Application Laid-open Publication No. 56-9742 (the Japanese Patent Application Publication No. 60-53307).

According to this method, a ring is disposed around a substrate with a gap formed between the surface of the substrate and the ring, and a developing solution is dripped inside the ring to thereby eliminate variations in the heaped-up thickness of the developing solution at the center section and the peripheral section of the substrate. However, although variations in the heaped-up thickness within the substrate surface can be eliminated by this method, it is difficult to obtain an always constant heaped-up thickness.

Particularly, when the substrate is rotated in order to fit the developing solution with a photo-sensitive resin like the conventional unit, a friction is generated between the fixed ring and the developing solution in contact with this ring, and thus there is a risk of an occurrence of variations in the surface of the solution resulting in variations in the heaped-up thickness of the developing solution.

SUMMARY OF THE INVENTION

It is, therefore, an object of the present invention to provide a developing unit which can keep always constant the heaped-up thickness of a developing solution without a traveling of the developing solution to the rear surface of the substrate.

The present invention provides a developing unit including a rotary chuck for holding a semiconductor substrate coated with a photo-sensitive resin, a developing solution nozzle for dripping a developing solution onto the photo-sensitive resin and a rinse solution nozzle for dripping a rinse solution onto the photo-sensitive resin. The developing unit further has a solution heap control panel. The solution heap control panel has a surface separated from a peripheral section of the semiconductor substrate at a predetermined distance therebetween and disposed with an inclination to the surface of the semiconductor substrate. The solution heap control panel brings the surface thereof into contact with an upper edge section of the outer periphery of the developing solution that has been dripped and heaped up on the rotating semiconductor substrate. Thereby, the panel ladles out and flows backwards the developing solution.

It is desirable that the developing unit further has a device for adjusting the distance between the peripheral section of the semiconductor substrate and the solution heap control panel. It is further desirable that a plurality of the solution heap control panels are disposed evenly around the outer periphery of the semiconductor substrate. It is further desirable that a groove gradually becoming deeper from the contact surface is formed on the surface extending downwards from the solution heap control panel in a direction to which the developing solution scatters by the rotation of the semiconductor substrate.

DESCRIPTION OF THE PREFERRED EMBODIMENTS

The present invention will be explained below with reference to the drawings.

Figure 1A:
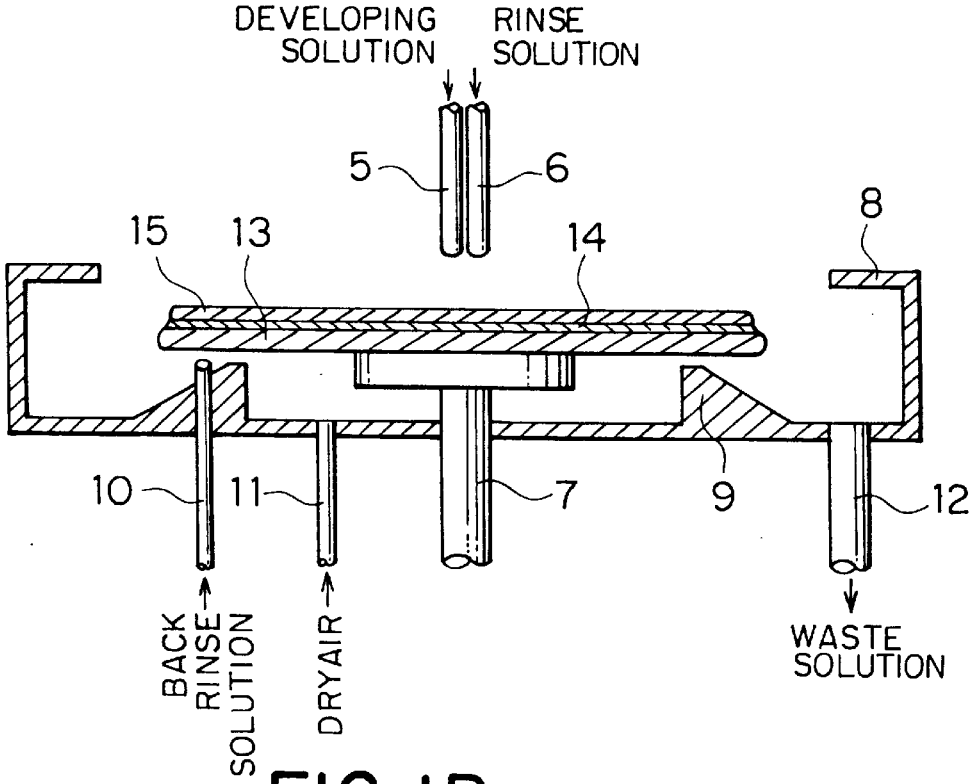
FIG. 1A (PRIOR ART)
FIG. 1A and FIG. 1B are a schematic cross sectional diagram and an operation line diagram respectively of a developing unit for explaining the developing unit according to one conventional example.
Figure 1B:
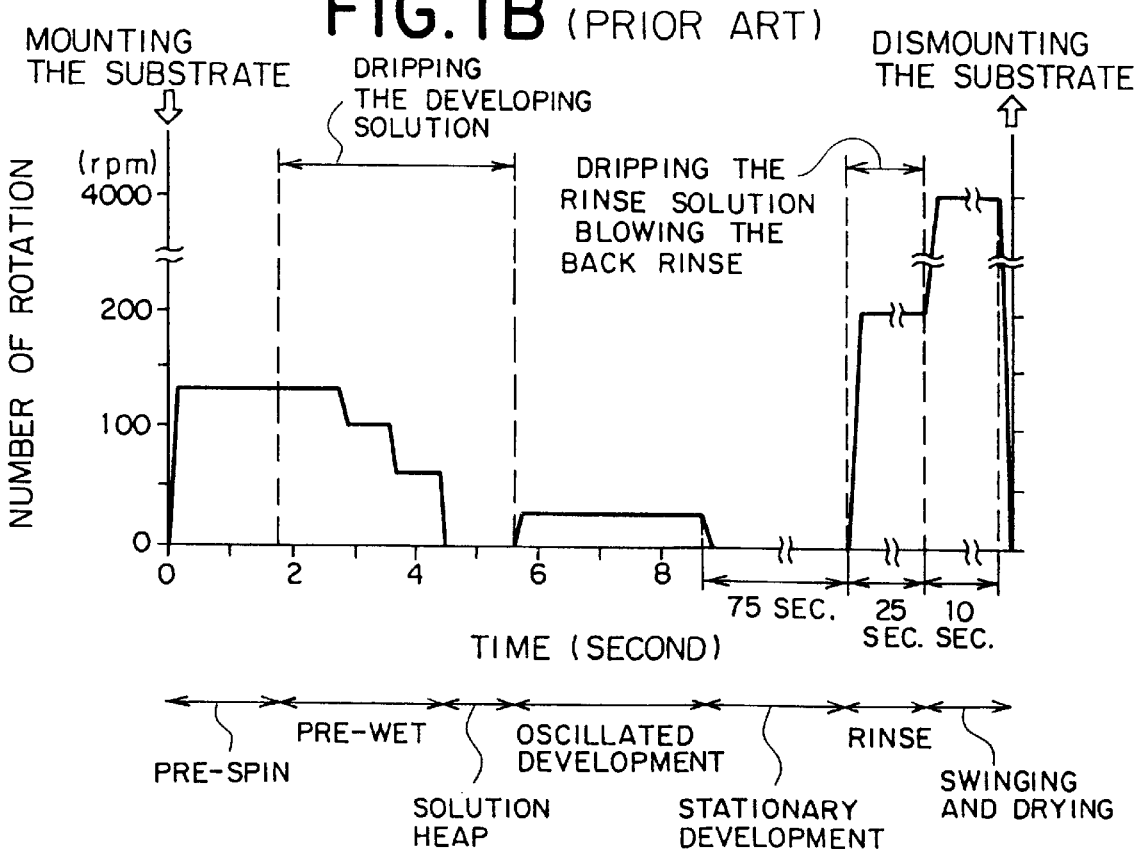
FIG. 1B (PRIOR ART)
Figure 2A:
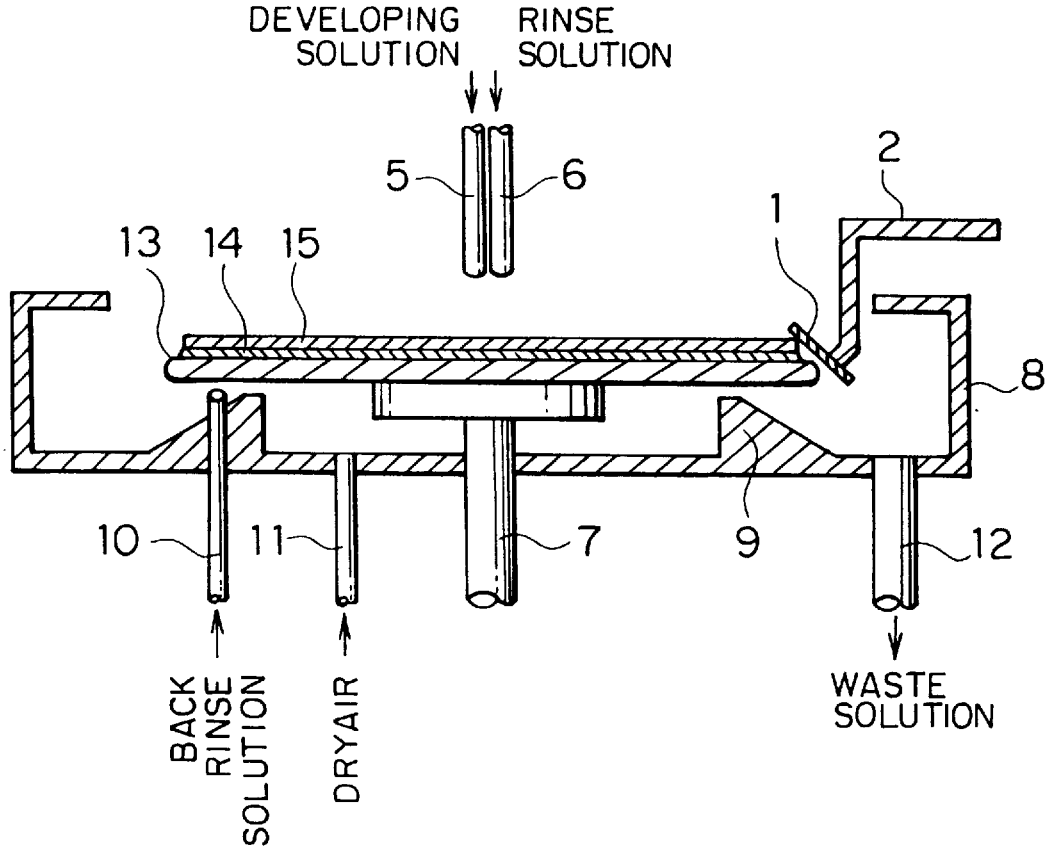
FIG. 2A and FIG. 2B are a schematic cross sectional diagram and a top plan view with a partial enlargement respectively of a developing unit according to one mode of implementation of the present invention.
Figure 2B:
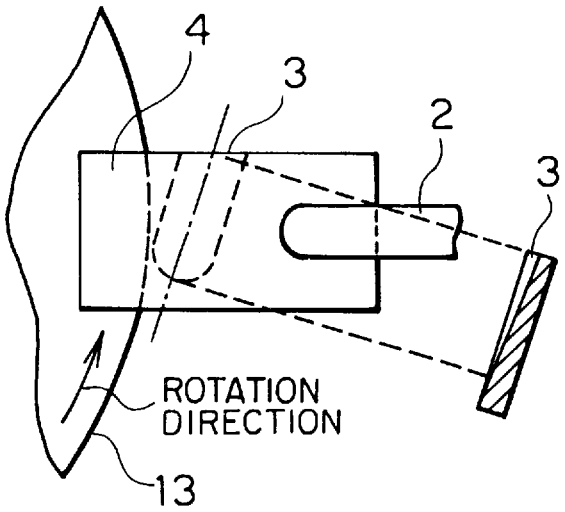

FIG. 2A and FIG. 2B are a schematic cross sectional diagram and a top plan view with a partial enlargement respectively of a developing unit according to a first embodiment of the present invention. As shown in FIG. 2, the developing unit has a solution heap control panel 1. The solution heap control panel 1 has a flat surface 4 separated from a peripheral section of a wafer 13 as a substrate at a predetermined distance therebetween and disposed with an inclination to the surface of the wafer 13. The panel 1 brings the flat surface 4 thereof into contact with an upper edge section of the outer periphery of a developing solution layer 15 that has been formed by dripping and heaping up the developing solution on the rotating wafer 13 so that the panel 1 ladles out and flows backwards the developing solution. All other parts including a developing solution nozzle 5, a rinse solution nozzle 6, a back rinse solution nozzle 10, a dry air nozzle 11, a rotary chuck 7 and a cup 8 having a waste solution discharging tube 12 are provided in a manner similar to the prior-art example.

According to the present invention, even if the developing solution has been dripped by a large volume and heaped up to a large thickness of the developing solution layer 15, the surplus developing solution is ladled out by bringing the flat surface 4 into contact with the upper edge section of the outer periphery of the developing layer 15. The developing solution ladled out by the solution heap control panel 1 flows on the flat surface and is dropped out with an adhesion on the solution heap control panel 1. In this case, it is desirable that a groove 3 gradually becoming deeper from the flat surface 4 is formed on the surface extending from the flat surface 4 in a direction to which the developing solution scatters by the rotation of the wafer 13 so that the dropping developing solution is guided easily.

Further, a supporting member 2 for fixing the solution heap control panel 1 is provided in order to be able to set the developing layer 15 at various thickness, and the supporting member 2 can be moved upwards and downwards with fine adjustment so that the developing solution layer 15 can have a desired thickness by adjusting the distance between the solution heap control panel 1 and the surface of the wafer 13. Further, if the solution heap control panel 1 becomes a hindrance in the operation of mounting and dismounting the wafer 13 onto and from the rotary chuck 7, the solution heap control panel 1 may be lifted to a constant height or set at a position with some distance from the wafer 13 by turning the control panel.

Figure 3:
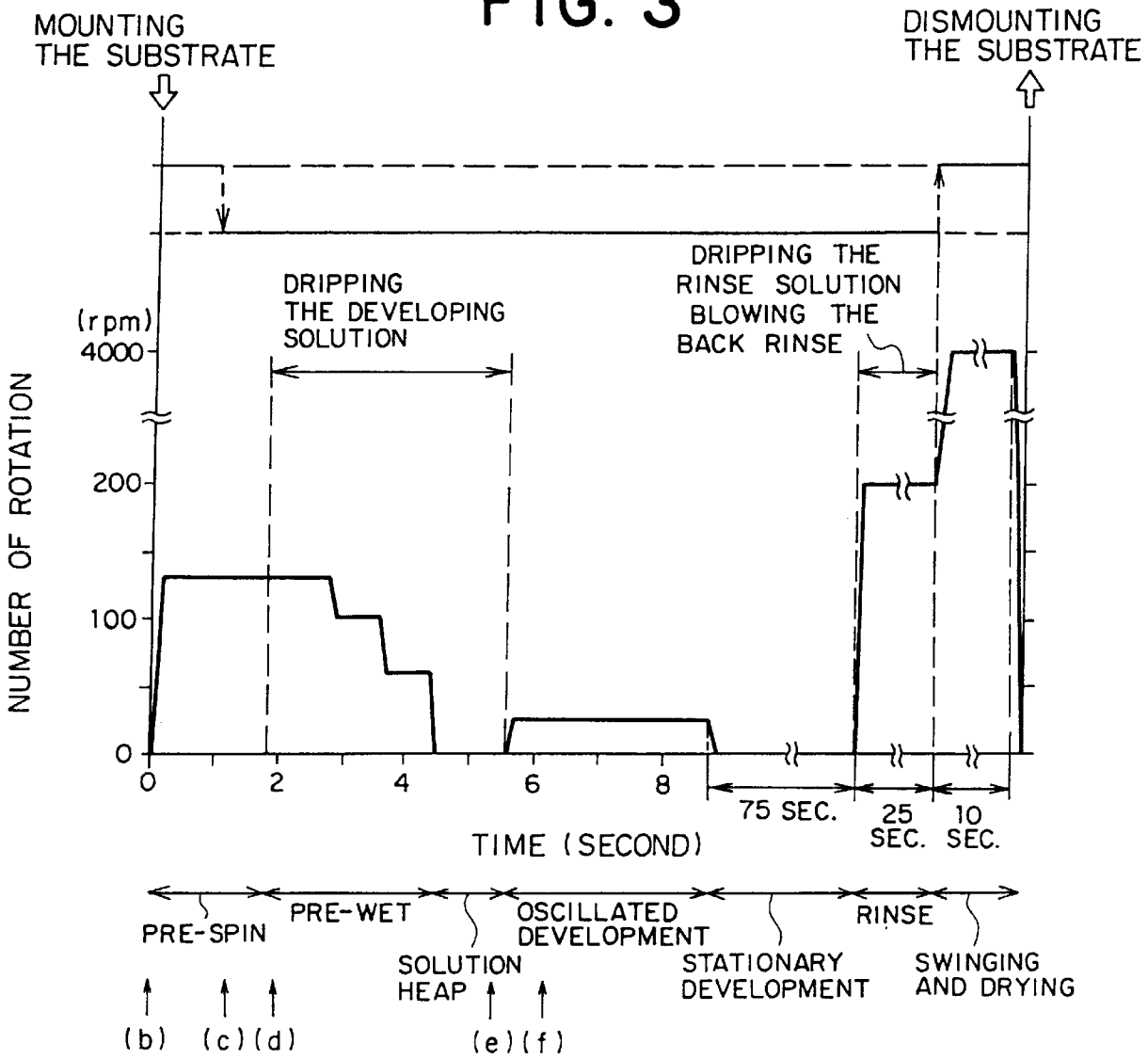
FIG. 3 is an operation line diagram for explaining the operation of the developing unit in FIG. 2.

FIG. 3 is an operation line diagram for explaining the operation of the developing unit in FIG. 2, and FIG. 4 is a diagram for showing the process of forming a developing solution in a heaped-up state in a developing solution layer having a predetermined thickness. The operation of the developing unit in FIG. 2 will be explained below with reference to FIG. 2, FIG. 3 and FIG. 4.

At first, a wafer 13 is mounted on the rotary chuck 7 in FIG. 2 to hold the wafer 13 on it. In this case, the solution heap control panel 1 is at a lifted position to avoid interfering the carrying of the wafer 13. Next, the wafer 13 in the process of pre-spin in FIG. 3 is rotated at a low speed. When the rotation of the wafer 13 has become constant, the solution heap control panel 1 is returned to the lower position and the distance between the wafer 13 and the solution heap control panel 1 is set so that the developing solution layer 15 has a desired thickness. Next, the developing solution is dripped from the developing solution nozzle 5 to a thickness larger than the thickness of the developing solution layer 15 while lowering the rotation of the wafer 13 at stages.

Figure 4A:
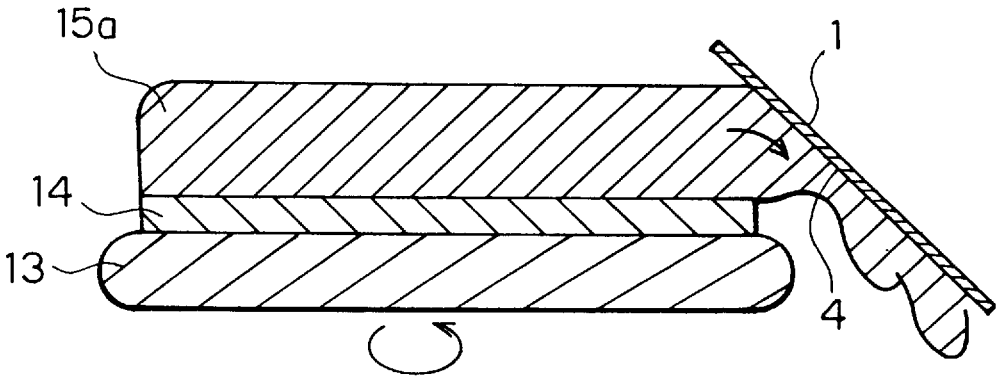
FIGS. 4A and FIG. 4B are a diagram for showing the process of forming a developing solution in a heaped-up state in a developing solution layer having a predetermined thickness.

In the pre-wet process for fitting the developing solution with the photo-sensitive resin film 14, a developing solution 15*a* in a heaped-up state is heaped up to a thickness larger than the planned thickness and the flat surface 4 of the solution heap control panel 1 is contacted to the upper edge portion of the outer periphery of the developing solution in the heaped-up state to ladle out the developing solution while rotating the wafer at an extremely low speed, as shown in FIG. 4A. The ladled-out developing solution flows on the flat surface 4 and falls downwards. The falling developing solution is dropped into the cup 8 positioned with a distance from the wafer 13.

Figure 4B:
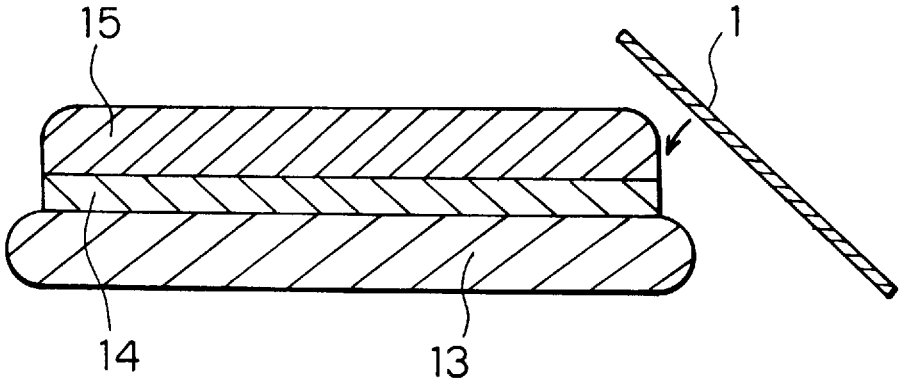

The rotation number of the wafer 13 in this case is determined by the surface tension and viscosity of the developing solution. In other words, it is important to rotate the wafer 13 at a speed at which the developing solution can move without being deviated from the wafer 13 by the centrifugal force generated by the rotation. When the wafer 13 has made a few rotations, as shown in FIG. 4B the surplus developing solution is ladled out and the developing solution layer 15 of a desired thickness is obtained. At this time, the rotation of the wafer 13 is stopped and the solution heaped-up state as shown in FIG. 3 is obtained.

Next, after the developing solution on the wafer 13 is oscillated by rotating the wafer 13 at a low speed in an oscillated development shown in FIG. 3, the rotation of the wafer 13 is stopped and a stationary development is carried out. After a lapse of a predetermined time, the wafer 13 is rotated at a high speed and the rinse solution is ejected from the rinse solution nozzle 6 and the nozzle 10 at the wafer rear surface side, to wash out the developing solution on the wafer 13 and the developing solution traveled to the rear surface. Then, after a predetermined period of time, the ejection of the rinse solution is stopped and the solution heap control panel 1 is lifted to be returned to the original position. Then, the wafer 13 is rotated at a still higher speed and the rinse solution remaining on the surface of the wafer 13 is dried and the rinse solution adhered to the rear surface of the wafer 13 is dried by dry air.

By providing the solution heap control panel 1 for ladling out the surplus developing solution to smooth the surface, a developing solution layer of a constant thickness can be obtained even if the volume of the dripped developing solution is slightly larger. Further, since the ladled-out developing solution flows out along a portion of the extended solution heap control panel 1, there remains no developing solution that has traveled to the rear surface of the wafer 13.

When the viscosity of the developing solution is low and the surface tension is weak, a plurality of the solution heap control panel may be disposed at equal intervals around the outer periphery of the wafer. It is desirable that a mechanism for adjusting the distance between the respective solution heap control panels and the wafer is installed independently. This is because it is necessary to adjust the distance between the solution heap control panels and the wafer at a disposed position of the solution heap control panels since the height of the wafer due to the rotation varies slightly depending on the position.

As explained above, according to the present invention, since there is provided the solution heap control panel for ladling out a surplus developing solution that has been heaped up on the substrate to have a developing solution layer of a desired thickness and for passing and flowing downwards the ladled-out developing solution while rotating the substrate, it becomes possible to form a developing solution layer of always a constant thickness on the surface of the substrate. Therefore, there is an effect that it is possible to obtain stable dimensions of a latent image pattern for an improved yield.

Further, since the ladled-out developing solution flows and drops out along the extension section of the solution heap control panel disposed at the outside of the substrate, the volume of the developing solution traveling to the rear surface of the substrate is decreased and the substrate is not polluted by the remaining developing solution. As a result, there is an effect that there occurs no quality defect.

What is claimed is:

1. A developing unit, comprising;

a rotary chuck for holding a semiconductor substrate coated with a photo-sensitive resin;

a developing solution nozzle for dripping a developing solution onto said photo-sensitive resin;

a rinse solution nozzle for dripping a rinse solution onto said photo-sensitive resin;

a solution heap control panel which has a surface separated from a peripheral section of said semiconductor substrate at a predetermined distance therebetween and disposed with an inclination to the surface of said semiconductor substrate, said solution heap control panel bringing said surface into contact with an upper edge section of the outer periphery of said developing solution that has been dripped and heaped up on said rotating semiconductor substrate, so that said solution heap controlling panel ladles out and flows backwards said developing solution.

2. A developing unit according to claim 1, further comprising a device for adjusting a distance between the peripheral section of said semiconductor substrate and said solution heap control panel.

3. A developing unit according to claim 1, wherein a plurality of said solution heap control panels are disposed evenly around the outer periphery of said semiconductor substrate.

4. A developing unit according to claim 2, wherein a plurality of said solution heap control panels are disposed evenly around the outer periphery of said semiconductor substrate.

5. A developing unit according to claim 1, further comprising a groove which gradually becomes deeper from said contact surface and is formed on the surface extending downwards from said solution heap control panel in a direction to which said developing solution scatters by the rotation of said semiconductor substrate.

6. A developing unit according to claim 2, further comprising a groove which gradually becomes deeper from said contact surface and is formed on the surface extending downwards from said solution heap control panel in a direction to which said developing solution scatters by the rotation of said semiconductor substrate.

7. A developing unit according to claim 3, further comprising a groove which gradually becomes deeper from said contact surface and is formed on the surface extending downwards from said solution heap control panel in a direction to which said developing solution scatters by the rotation of said semiconductor substrate.

8. A developing unit according to claim 4, further comprising a groove which gradually becomes deeper from said contact surface and is formed on the surface extending downwards from said solution heap control panel in a direction to which said developing solution scatters by the rotation of said semiconductor substrate.

* * * * *